US007665280B2

(12) United States Patent
Youell, Jr. et al.

(10) Patent No.: US 7,665,280 B2
(45) Date of Patent: Feb. 23, 2010

(54) AUTOMOBILE PART SHIPPING SYSTEM AND METHOD

(75) Inventors: Donald R. Youell, Jr., Dublin, OH (US); Rudy Youell, Dublin, OH (US)

(73) Assignee: American Corrugated Products, Inc., Columbus, OH (US)

( * ) Notice: Subject to any disclaimer, the term of this patent is extended or adjusted under 35 U.S.C. 154(b) by 9 days.

(21) Appl. No.: 12/313,281

(22) Filed: Sep. 2, 2008

(65) Prior Publication Data

US 2009/0056280 A1 Mar. 5, 2009

Related U.S. Application Data

(62) Division of application No. 09/865,229, filed on May 25, 2001, now abandoned.

(51) Int. Cl.
*B65B 23/20* (2006.01)
*B65D 85/48* (2006.01)

(52) U.S. Cl. ..... 53/472; 53/427; 53/411; 53/452; 206/448

(58) Field of Classification Search ..... 53/411, 53/427, 472, 442, 449, 452, 131.1; 206/448, 206/484, 497, 583
See application file for complete search history.

(56) References Cited

U.S. PATENT DOCUMENTS 2,337,468 A * 12/1943 Hilger ..... 206/454
2,734,626 A * 2/1956 Koester ..... 206/448
2,741,362 A * 4/1956 Cortright ..... 206/453
2,776,745 A * 1/1957 Antwerpen ..... 206/453
2,806,592 A * 9/1957 Hatfield ..... 206/448
2,807,360 A * 9/1957 Nurre ..... 206/448
2,919,022 A * 12/1959 Lidgard ..... 206/448
2,967,009 A * 1/1961 Lidgard ..... 206/448
3,028,001 A * 4/1962 Gleim ..... 206/448
3,043,488 A * 7/1962 Warwick ..... 206/448
3,044,615 A * 7/1962 Richardson ..... 206/448
3,166,188 A * 1/1965 Koester ..... 206/448
3,385,462 A * 5/1968 Deldime et al. ..... 53/447
3,389,785 A * 6/1968 Lidgard ..... 206/448
3,403,778 A * 10/1968 Voytko et al. ..... 206/448
3,414,124 A * 12/1968 Lidgard ..... 206/448
3,519,244 A * 7/1970 Lidgard ..... 206/454
3,756,397 A * 9/1973 Ganz ..... 206/432
3,878,943 A * 4/1975 Ryan et al. ..... 206/497
3,884,356 A * 5/1975 Lidgard ..... 206/591
3,990,576 A * 11/1976 Heaney ..... 206/453

(Continued)

*Primary Examiner*—Paul R Durand
(74) *Attorney, Agent, or Firm*—Mueller Smith & Okuley, LLC

(57) ABSTRACT

Plies of paperboard are laminated to form a paperboard laminate having a front and a back. An automobile part is placed on the front of the paperboard laminate leaving exposed the front of the paperboard laminate. The automobile part and the exposed paperboard laminate are shrink-wrapped with plastic shrink-wrap material. For automobile window glass, some of the front side plies of the paperboard laminate have been cut out to form a cavity in the configuration of the glass product being packaged. The glass product is disposed in the cavity and a glass product conforming reinforcing block is placed against the backside of the paperboard laminate during the shrink-wrap operation. For automobile fenders, hoods, the paperboard laminate need not be cut out and the sides of the paperboard laminate are folded upwardly to form a carton bottom to which a lid is affixed for shipping.

8 Claims, 6 Drawing Sheets

U.S. PATENT DOCUMENTS 4,225,043 A * 9/1980 Lastik ..... 206/448
4,287,990 A * 9/1981 Kurick ..... 206/448
4,306,653 A * 12/1981 Fales ..... 206/326
4,805,774 A * 2/1989 Salisbury ..... 206/454
4,899,880 A * 2/1990 Carter ..... 206/448
5,101,976 A * 4/1992 Salisbury ..... 206/454
5,269,422 A * 12/1993 Chevrette ..... 206/448
5,595,301 A * 1/1997 Putz et al. ..... 206/449
5,992,630 A * 11/1999 Brown et al. ..... 206/497
6,149,009 A * 11/2000 DeNola ..... 206/586
6,722,500 B2 * 4/2004 Deiger ..... 206/454
6,769,548 B2 * 8/2004 Morell et al. ..... 206/586
6,880,313 B1 * 4/2005 Gessford et al. ..... 53/442
6,886,692 B2 * 5/2005 Allison ..... 206/448
6,938,396 B2 * 9/2005 Okamoto ..... 53/447
7,080,735 B2 * 7/2006 Allison ..... 206/448
7,419,055 B2 * 9/2008 Manuel ..... 206/523
7,533,771 B2 * 5/2009 Allison ..... 206/448

* cited by examiner

AUTOMOBILE PART SHIPPING SYSTEM AND METHOD

CROSS-REFERENCE TO RELATED APPLICATIONS

This application is a division of prior U.S. Ser. No. 09/865,229, filed May 25, 2001, the disclosure of which is expressly incorporated by reference.

STATEMENT REGARDING FEDERALLY SPONSORED RESEARCH

Not applicable.

BACKGROUND OF THE INVENTION

The present invention relates generally to packaging container systems for shipping breakable and other articles and more particularly to a packaging container system for shipping automobile window glass and other automobile parts and assemblies.

The safe shipping of automobile glass products (e.g., front windows, rear windows, side window, etc.) from the glass manufacturer to the automobile assembly plant presents particular difficulty, especially for large curved glass products. All parties-glass manufacturer, shipper, automobile assembler-accept breakage of a significant percentage of such large glass products. These same comments apply to other automobile parts, such as, for example, hoods, fenders, doors, and the like. Shipment without damage is difficult to achieve. Prior attempts to package automobile glass and other products have proven futile.

U.S. Pat. No. 5,836,448 proposes a rigid surface having a layer of foam bonded thereto with an adhesive coating the foam. The china or other item to be shipped is adhesively held in place. U.S. Pat. No. 4,287,990 proposes to sandwich glass sheet inside a male/female waffle foam carrier pair and to secure the waffle foam panels together. U.S. Pat. No. 5,101,976 proposes to ship automobile glass and metal parts held in place by a U-shaped channels disposed atop and on the bottom of an elongate rigid body member. U.S. Pat. No. 4,225,043 proposes to ship automobile glass secured by slotted foam blocks. U.S. Pat. No. 4,353,466 proposes to ship automobile glass in adhesively coated notched logs, where the upstanding glass sheets rest in the notches. U.S. Pat. No. 5,644,898 proposes to apply a liquid between automobile glass wherein the liquid cools to elastomeric spacers between the glass. U.S. Pat. No. 4,182,450 proposes to pack automobile glass between slotted brackets and place the assembly inside packing containers.

Despite these proposals, there exists a real need in the automobile industry for shipping container systems of small overall size, which afford improved protection for the parts being shipped. It is to such need that the present invention is addressed.

BRIEF SUMMARY OF THE INVENTION

Method for shipping an automobile part, which commences with laminating plies of paperboard for forming a paperboard laminate having a front and a back. The automobile part is placed on the front of said paperboard laminate leaving exposed some front areas of the paperboard laminate. The automobile part product and the exposed areas of the paperboard laminate are shrink-wrapped with plastic shrink-wrap material.

A packaging system for shipping of a glass product includes laminated plies of paperboard, which form a paperboard laminate having a front and a back. Some of the front side plies of the paperboard laminate have been cut out to form a cavity in the configuration of the glass product being packaged. The glass product is disposed in the cavity and is shrink-wrapped therein with plastic shrink-wrap material. Advantageously, a foam block is attached to the front side and backside of the shrink-wrapped glass product and the entire structure is placed inside a shipping carton for safe shipment.

The corresponding method for packing glass in a packaging system, which commences with laminating plies of paperboard to form a paperboard laminate having a front and a back. A glass product conforming reinforcing block is affixed to the back of the paperboard laminate. Some of the front side said plies of said paperboard laminate are cut out to form a cavity in the configuration of a glass product. The glass product is placed in the cavity and is shrunk-wrapped with plastic shrink-wrap material therein. Advantageously, a foam block is attached to the front side and backside of the shrink-wrapped glass product and the entire structure is placed inside a shipping carton for safe shipment.

Method for packing a metal or composite automobile part in a packaging system commences with laminating plies of paperboard to form a paperboard laminate having a front and a back, and foldable ends. An automobile part is placed on the front of the paperboard laminate leaving a balance of the front exposed. The balance of the front exposed paperboard laminate and the automobile part product are shrink-wrapped with plastic shrink-wrap material. The laminated foldable ends are folded upwardly to form a carton bottom having an open top and the shrink-wrapped automobile part disposed therein. A lid then is placed over the cavity.

For present purposes "paperboard" is corrugated paper, an oft-used product in the shipping container and carton industry.

BRIEF DESCRIPTION OF THE DRAWINGS

For a fuller understanding of the nature and advantages of the present invention, reference should be had to the following detailed description taken in connection with the accompanying drawings, in which.

The drawings will be described in more detail below.

DETAILED DESCRIPTION OF THE INVENTION

Laminate structures provide greater strength than solid structures of the same thickness. In the present invention, such greater strength is but one consideration in opting for use of a laminate structure. Of similar importance is the prevention of the object being shipped from moving, shifting, or otherwise changing position during loading, shipping, and storage of the object. Smaller objects, even delicate and breakable objects, are easier to pack for shipment because of their small size. When the object is large and heavy, such as an automobile structural part, proper packing for its safe shipment is anything but routine. Even "unbreakable" structural automobile parts, such as hoods, fenders, and doors, can become scratched, dented, and abraded to the point that rework of the part is needed. When the structural automobile parts are breakable and non-planar, such as automobile windshield glass, the packing problems become even more compounded. Now, the packer must be attentive to scratching, abrading, breaking, and stress, of a part that can weigh upwards to several hundred pounds. A daunting task for the part manufacturer and shipper indeed.

Figure 1:
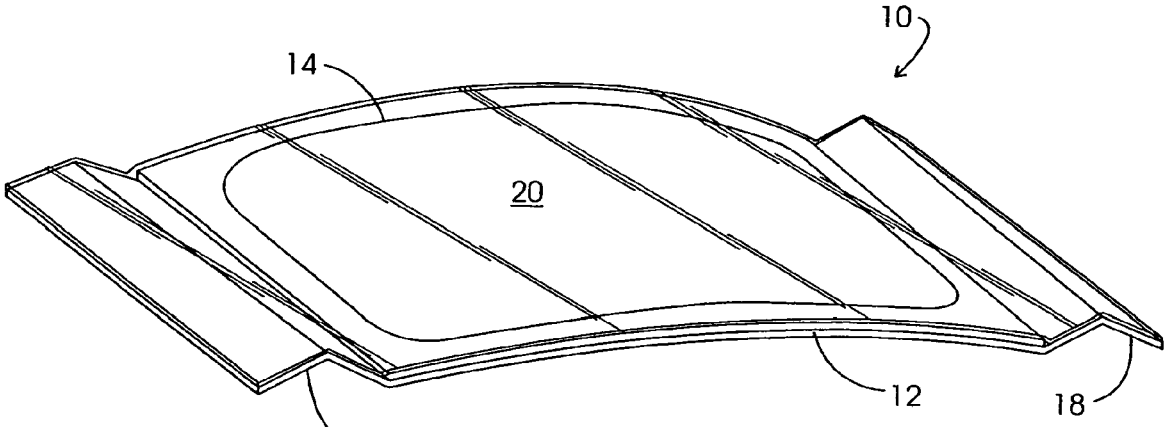
FIG. 1 is a perspective view of the paperboard laminate with inserted automobile window glass with the sides of the laminate being in an unfolded condition.

Referring initially to FIG. 1, a paperboard laminate/automobile window glass laminate assembly, 10, is seen in perspective view to be composed of a paperboard laminate assembly, 12, and a piece of automobile window glass, 14. A cavity formed in the front or topside of paperboard laminate assembly 12 matches the outer configuration of automobile window glass 14, which fits snugly therein. The ends of paperboard laminate assembly 12, 16 and 18, are seen to be bi-folded. Overlaying the front side of topside of paperboard laminate assembly 12, automobile window glass 14, and bi-fold laminate ends 16 and 18, is a sheet of plastic shrink-wrap material, 20, which has been heat/vacuum bonded thereto to produce a laminate structure.

While paperboard laminate assembly 12 could be made from a single piece of corrugate sheet of equivalent thickness, the preferred laminate structure is stronger. Also, the laminate construction permits plies of paperboard sheet to be removed for forming the cavity adapted to receive window glass 14. In this regard, paperboard laminate assembly 12 could be manufactured from plies already containing die cuts and then laminated, or the solid laminate plies can be joined (e.g., by an adhesive, such as a hot melt adhesive) and then the plies die cut form forming the cavity. Either technique is suitable for present purposes.

Figure 2:
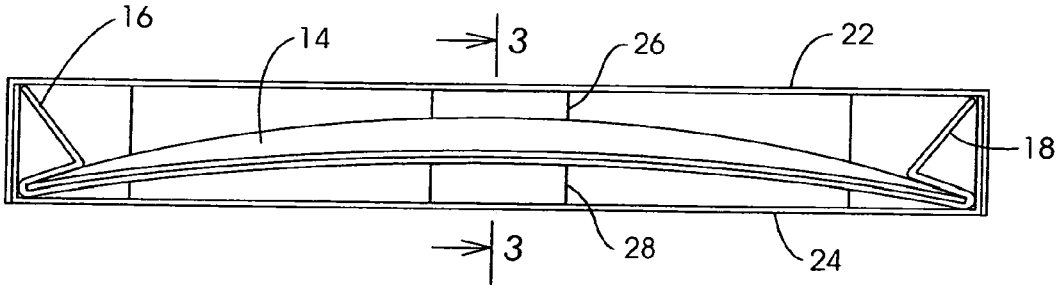
FIG. 2 is a side view of the paperboard laminate of claim 1 with the ends being folded inward and the entire laminate structure placed inside a shipping carton.
Figure 3:
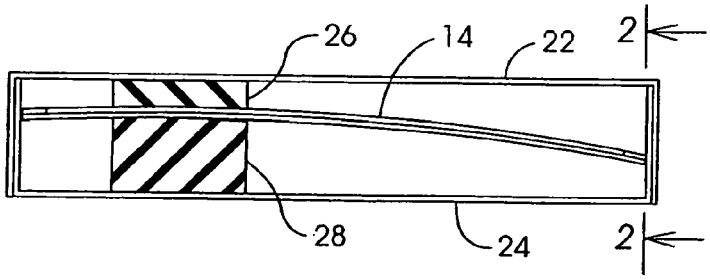
FIG. 3 is a cross-sectional view taken along line 3-3 of FIG. 2.

Bi-fold laminate ends 16 and 18 and folded upwardly so as to pinch or crimp the ends of window glass 14, such as is seen in FIGS. 2 and 3, and paperboard laminate/automobile window glass laminate assembly 10 is placed inside a shipping carton formed from a lid, 22, and a base, 24. Such pinching/crimping of the ends of window glass 14 further prevents it from becoming dislodged or moved during the shipping operation. A pair of foam blocks, 26 and 28, are placed on either side of automobile window glass 14, to protect glass 14 should top 22 or base 24 become crushed during handling and shipping operations.

Figure 4:
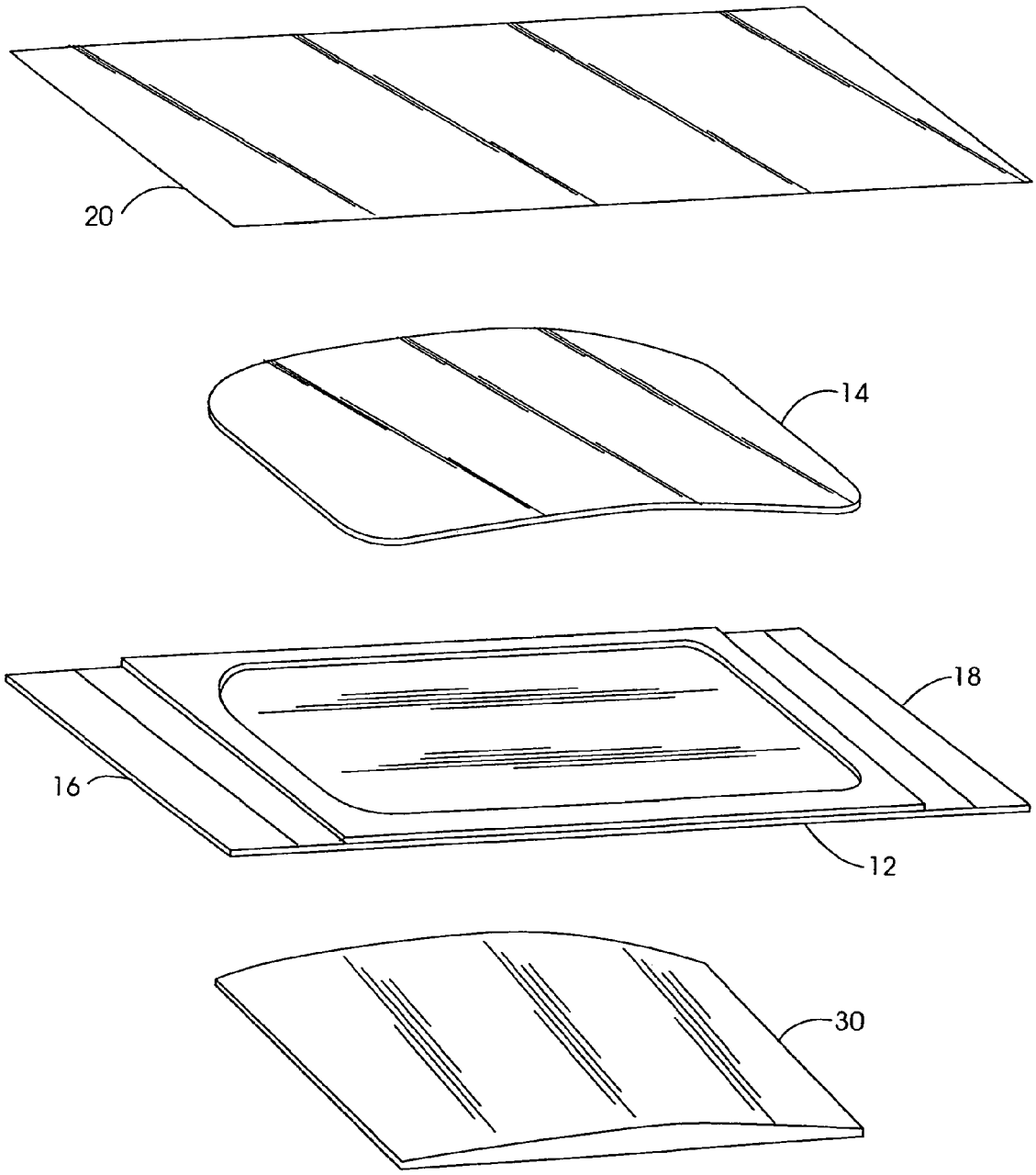
FIG. 4 is a perspective view of the paperboard laminate/automobile window glass assembly of FIG. 1 with its component parts sequenced for assembly.

Referring to FIG. 4, shown are the components of paperboard laminate/automobile window glass laminate assembly 10 in the arrangement for their assembly, viz., plastic shrink-wrap sheet 20, window glass 14, and paperboard laminate assembly 12. During the shrink-wrap operation, it was determined that window glass 14 was subject to breakage due to the stress placed on it and its curved shaped. Backing block 30 was found to prevent such breakage due to its upper surface having the same (convex) shape as window glass 14's lower (concave) shape. Of course, window glass 14 could be flipped around so that its convex surface is facing down, which would necessitate the upper surface of backing block 30 being concave in shape. So long as the upper surface of backing block 30 mates with the lower surface of window glass 14, a suitable arrangement has been made. Should window glass 14 be planar, backing block 30 no longer would be required, as the lower platen of the shrink-wrap machine would provide the necessary backing for window glass 14 during the shrink-wrapping operation.

FIGS. 5-9 depict shrink-wrap machine 32, which takes the assembly depicted in FIG. 4 and effects the production of paperboard laminate/automobile window glass laminate assembly 10, and the various manufacturing steps that machine 32 executes. Commencing with FIG. 5, a vacuum chamber, 34, is seen to include a control panel, 36. Vacuum chamber 34 supports a lower foraminous platen, 38, upon which an end, 40, of a roll of shrink-wrap plastic, 42, rests. An overhead superstructure, 44, supports an overhead hydraulically driven platen, 46, whose lower surface bears a plurality of suction cups, a suction cup, 48, being label as illustrative thereof. Platen 46 also generates heat, preferably by electrical resistance, though other heating means certainly can be used.

Figure 5:
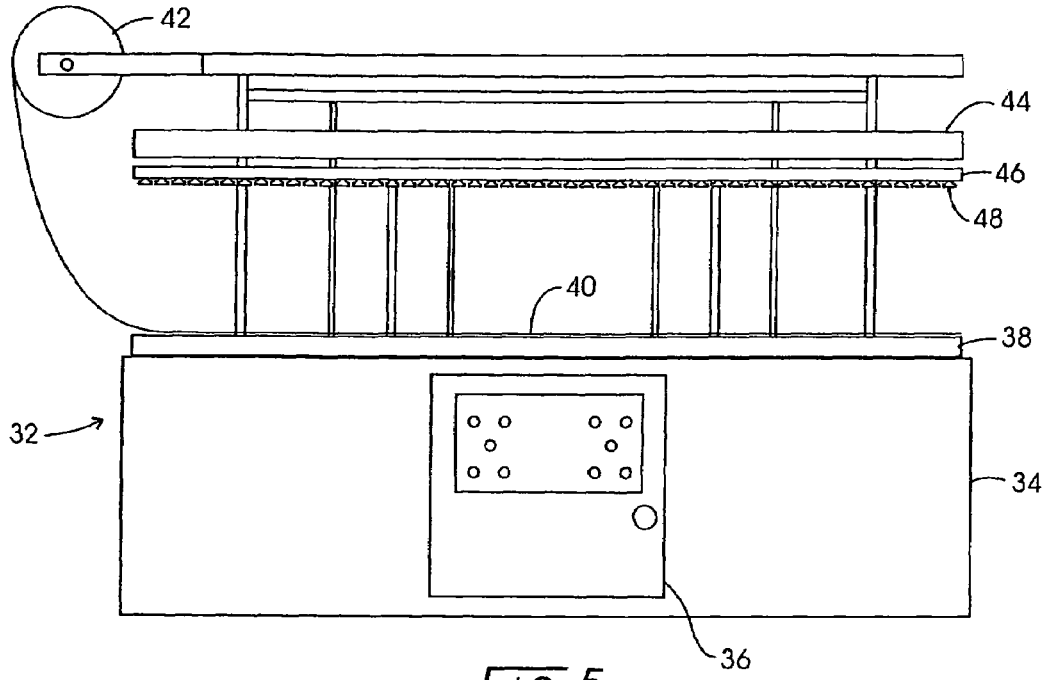
FIG. 5 is a front elevational view of the machine that shrink-wraps the automobile window glass to the paperboard laminate in the machine's first step.
Figure 6:
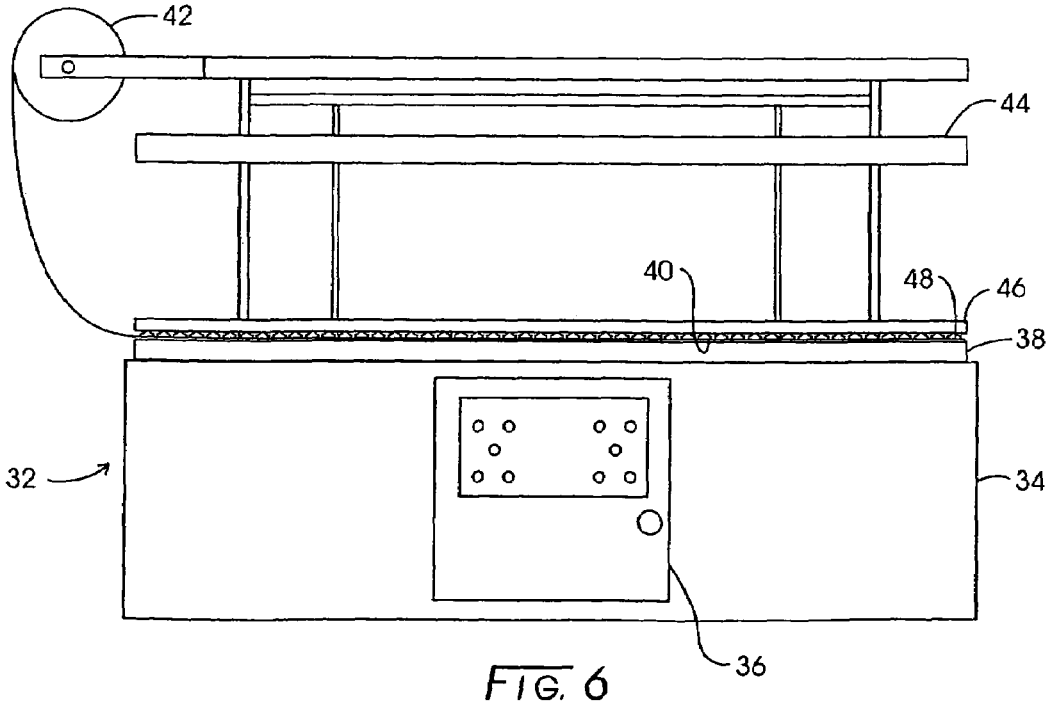
FIG. 6 is the machine is of FIG. 5 with the upper suction cup plate lowered to pick up the shrink-wrap plastic material.
Figure 7:
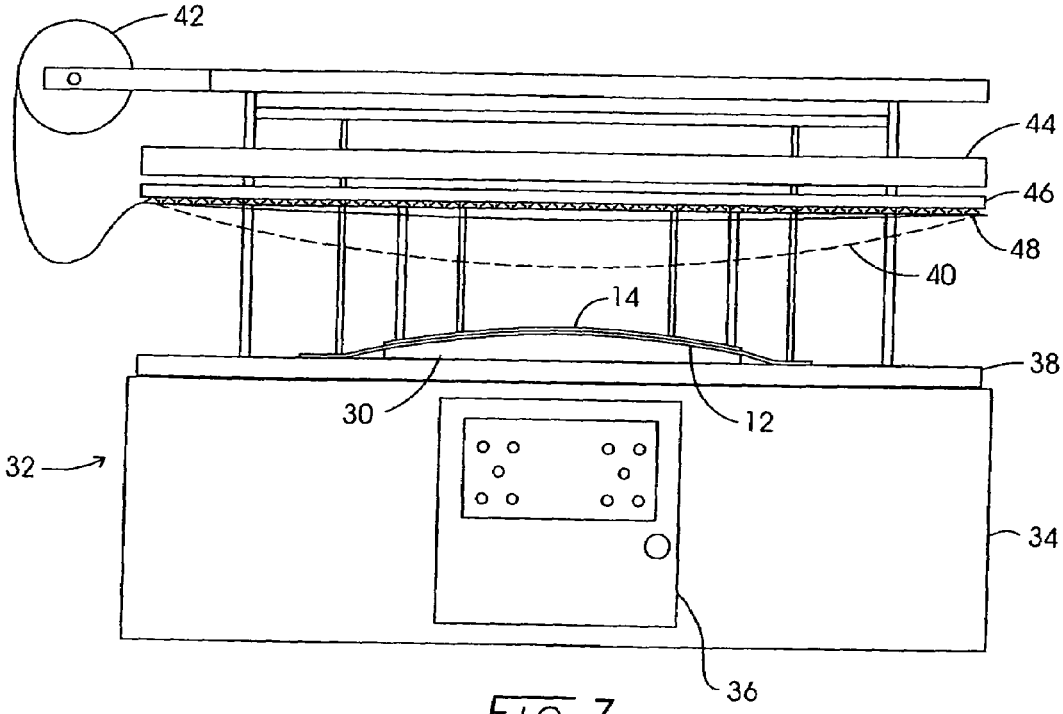
FIG. 7 is the machine of FIG. 5 with the upper suction cup plate in its upper position in the heating mode wherein the shrink-wrap plastic material stretches and sags as it is heated.

In the first step of the operation as shown in FIG. 5, shrink-wrap end 40 is placed atop foraminous platen 38. In the second step of the operation as shown in FIG. 6, platen 46 is lowered for its suction cups to be pressed against end 40. Platen 46 then is raised and heating commenced. Such heating softens end 40 causing it to stretch, as can be seen by the sagged dotted line in FIG. 7. In fact, an experienced machine operator can tell if end 40 has been sufficiently heated by the amount of sag.

Figure 8:
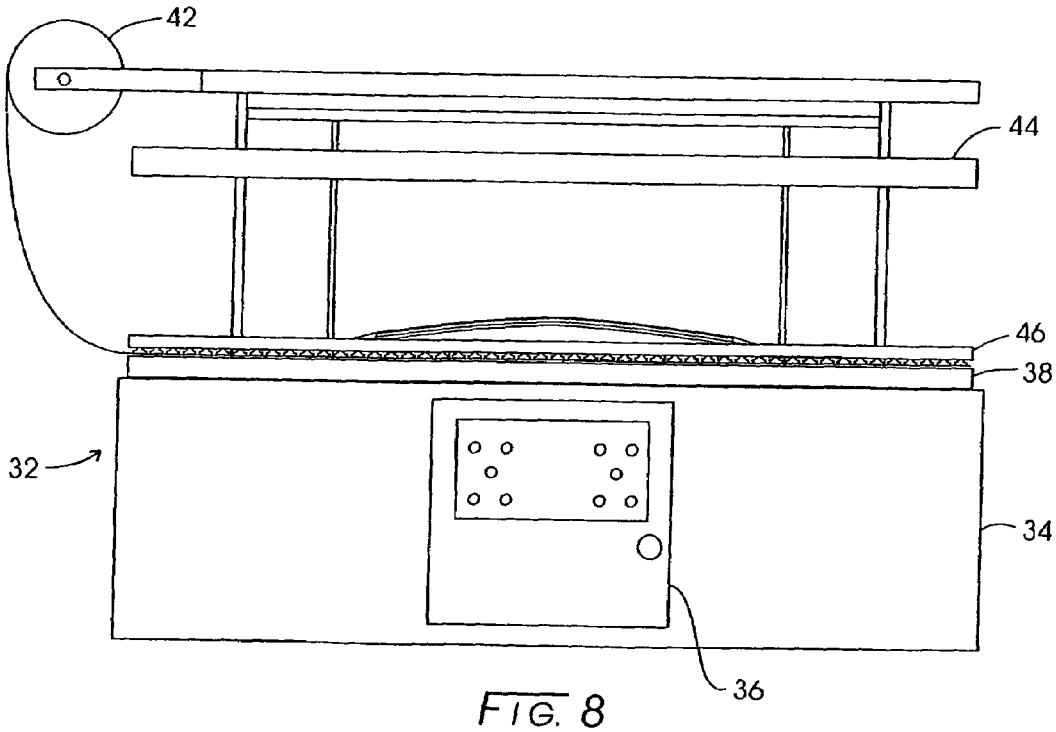
FIG. 8 is the machine of FIG. 5 with the heated shrink-wrap plastic material being lowered by the upper suction cup plate onto the automobile glass/paperboard laminate assembly.
Figure 9:
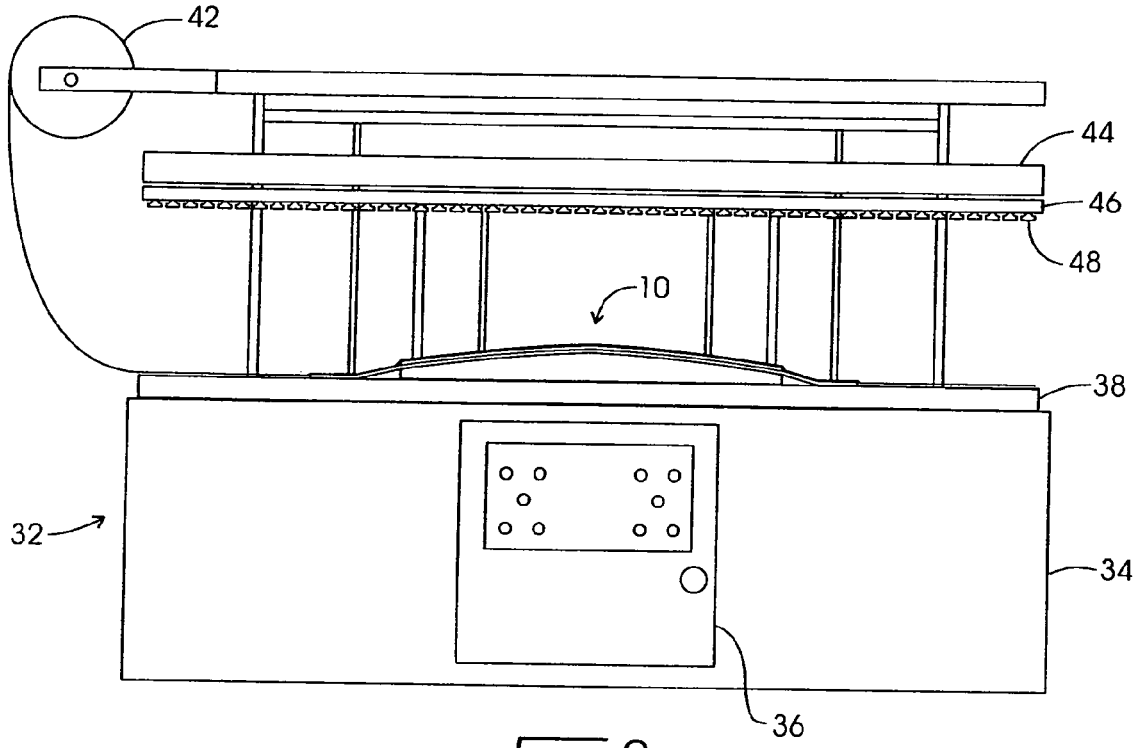
FIG. 9 is the machine of FIG. 5 with the upper suction plate returned to its upper position and a vacuum being pulled to laminate the shrink-wrap to the automobile glass/paperboard laminate assembly.

Next, the assembly of FIG. 4 is placed atop lower foraminous platen 38 and heated end 40 is draped thereover by lowering platen 46, as shown in FIG. 8. At that time platen 46 is raised and, as shown in FIG. 9, vacuum is applied by vacuum chamber 34 which causes heated end 40 to bond tightly to window glass 14 and ends 16 and 18 of paperboard laminate assembly 12. Cooling of end 40 causes window glass 14 and ends 16 and 18 of paperboard laminate assembly 12 to be placed under tension by shrink-wrap end 40 and tight bond is formed. The resulting product is paperboard laminate/automobile window glass laminate assembly 10 of FIG. 1. Shrink-wrap end 40 can be cut and laminate assembly 10 removed from machine 32 and the process repeated.

When the automobile part is a metal and/or composite part (hood, fender, door panel), the extra precaution of the cavity in the paperboard laminate need not be taken. Rather than breaking, such metal and/or composite parts need protection from scrapes, abrasions, scratches, dents, and the like. Such protection is afforded by the same shrink-wrapping technique sans the cavity.

Figure 10:
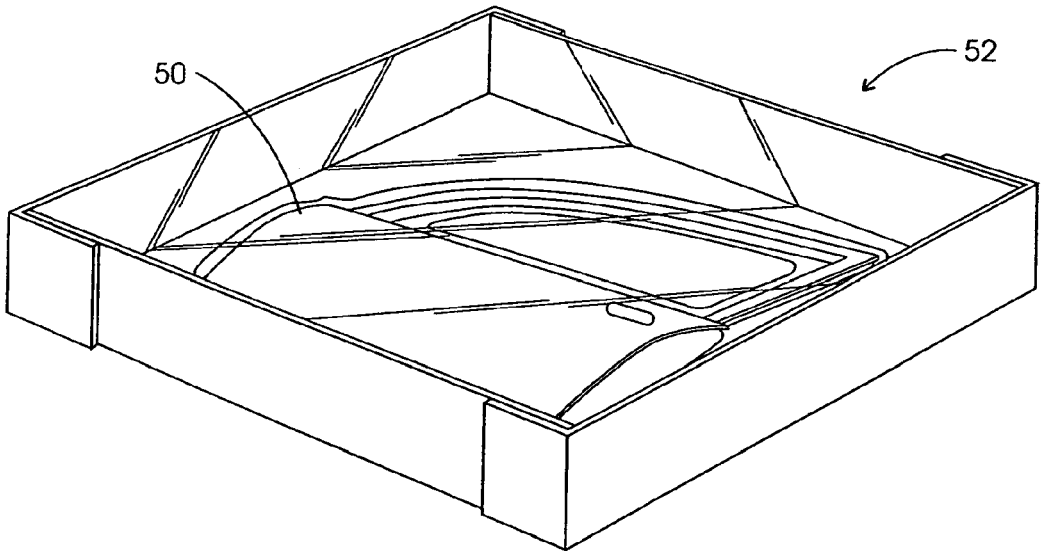
FIG. 10 is a perspective view of another embodiment of the present invention wherein an automobile door is laminated to a paperboard box with shrink-wrap material.

Referring initially to FIG. 10, a door, 50, can be seen disposed in a carton bottom, 52. Door 50 will be seen to be shrink-wrapped to carton 52. Also, the upstanding sides of carton 52 also are seen to be shrink-wrapped. A lid, like lid 22 (see FIG. 2) can be placed over the open upper cavity for shipment of door 50.

Figure 11:
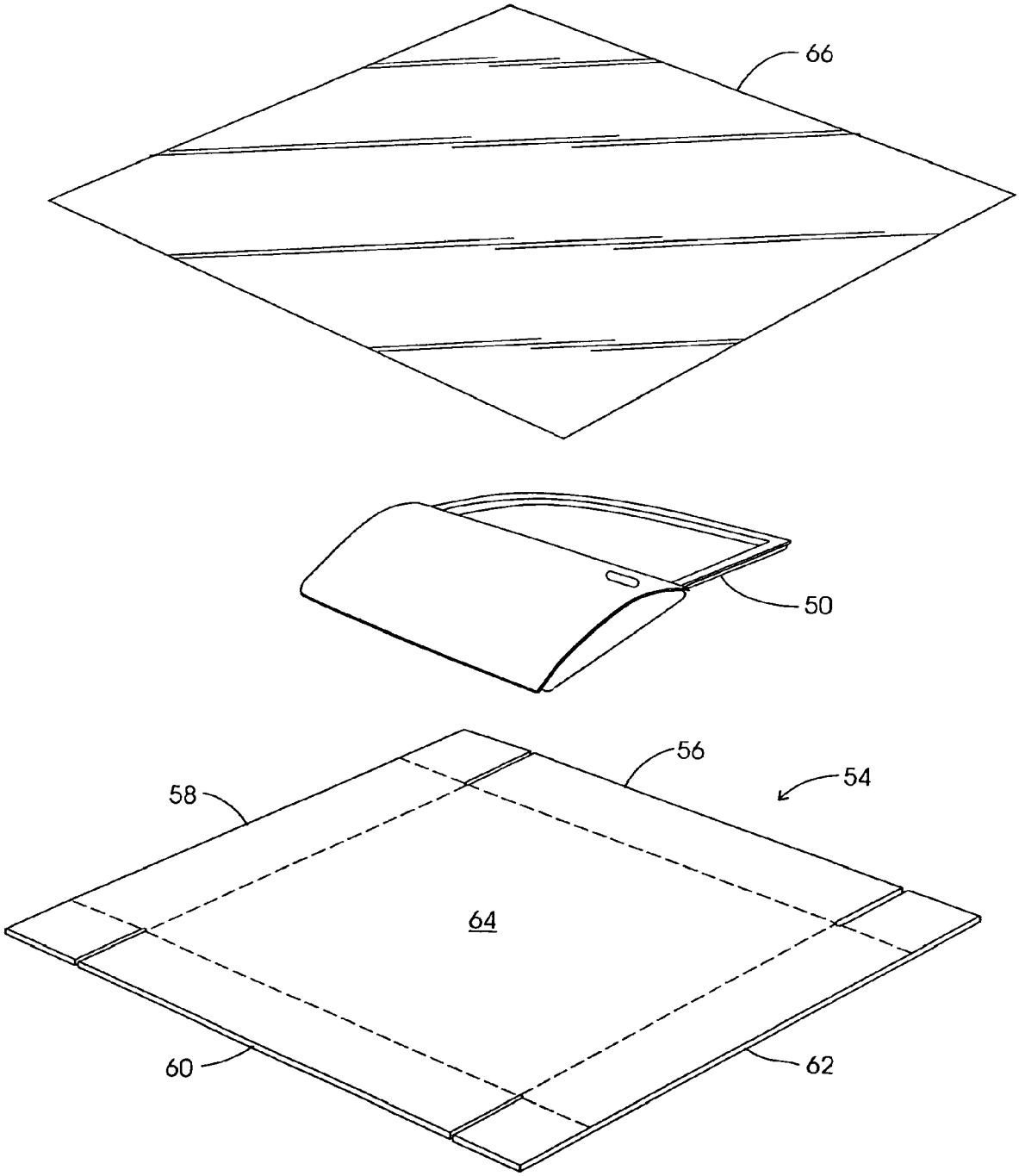
FIG. 11 is a perspective view of the paperboard container/automobile door glass assembly of FIG. 10 with its component parts sequenced for assembly.

The formation of the unique packaging system of FIG. 10 is seen by referring to FIG. 11. Shrink-wrap material, 66, is seen to be located above door 50, which in turn is seen to be located above a paperboard sheet, 54. Paperboard sheet 54 has four ends or edge pieces, 56, 58, 60, and 62. Folding sides 56, 58, 60, and 62 upwardly forms the sides of carton 52. Door 50 is placed on the central flat section, 64, of paperboard sheet 54.

The assembly shown in FIG. 10 can be formed using shrink-wrap machine 32 by using the same process described in connection with FIGS. 5-9. The only difference is that the inside of door panel 60 is substantially flat and unbreakable, so that a backing block (e.g., backing block 30) is not needed. Rather, foraminous platen 38 serves adequately as a backing block during the shrink-wrapping operation. The ruggedness and durability of door 50 also permits it to be packaged directly by simply folding sides 56, 68, 60, and 62 upwardly and securing them by means of hot melt adhesive, tape, or the like, to form a carton with an open top. The shipper then need only place and secure a lid thereto to produce a unique packaging system that minimizes, if not eliminates, door panel 50 from becoming scratched, dented, or otherwise abraded during the shipping operation. Also, a very compact, light-weight shipping system yields such safe shipping of large automobile parts.

Shrink-wrap material preferably is heat-shrinkable plastic film (e.g., polyolefins, such as, polyethylene, polypropylene, polyesters, PVC, polyvinylidene chloride, polystyrene) that shrinks upon heating to place an object under tension. Alternatively, it may be stretch wrap film that has long-term elastic memory with great stretch (e.g., up to 300%, and desirably, about 100% to 250%, such as a cast extruded multi-layered stretched polyethylene film) so that it can place sufficient tension on the automobile glass product or other part to secure it for safe shipment.

While the invention has been described with reference to a preferred embodiment, those skilled in the art will understand that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In this application all units are in the metric system and all amounts and percentages are by weight, unless otherwise expressly indicated. Also, all citations referred herein are expressly incorporated herein by reference.

The invention claimed is:

1. Method for packing a glass product in a packaging system, which comprises the steps of:

(a) laminating plies of paperboard to form a paperboard laminate having a front and a back;

(b) cutting out some of the front said plies of said paperboard laminate to form a cavity in the configuration of a glass product and leaving uncut the balance of said front said plies;

(c) placing said glass product in said cavity;

(d) affixing a glass product conforming reinforcing block to the back of said paperboard laminate; and (e) shrink-wrapping with plastic shrink wrap material said glass product in said cavity and said uncut balance of said front said plies.

2. Method of claim 1, wherein said shrink-wrap material comprises heat-shrinkable plastic film selected from one or more of a polyolefin, a polyester, a polyvinyl chloride, a polyvinylidene chloride, or a polystyrene.

3. Method of claim 1, wherein said glass product is an automobile window glass.

4. Method of claim 3, wherein a foam block is affixed to said back of said paperboard laminate and a foam block is affixed to said shrink-wrap material adhered to said window glass, and said packaging system is placed in a carton for shipping; and wherein said glass produce has ends and said paperboard laminate has ends, said laminate ends being folded upwardly to engage and pinch the ends of said glass product.

5. Method of claim 4, wherein said shrink-wrap material comprises heat-shrinkable plastic film selected from one or more of a polyolefin, a polyester, a polyvinyl chloride, a polyvinylidene chloride, or a polystyrene.

6. Method of claim 1, wherein said paperboard laminate is formed of between 2 and 4 plies of paperboard.

7. Method of claim 1, wherein a foam block is affixed to said back of said paperboard laminate and a foam block is affixed to said shrink-wrap material adhered to said window glass, and said packaging system is placed in a carton for shipping.

8. Method of claim 1, wherein said glass produce has ends and said paperboard laminate has ends, said laminate ends being folded upwardly to engage and pinch the ends of said glass product.

* * * * *